US006500039B1

(12) United States Patent
Underwood

(10) Patent No.: US 6,500,039 B1
(45) Date of Patent: Dec. 31, 2002

(54) LEASH FOR SECURING A SURF CRAFT TO A LIMB OF A PERSON

(76) Inventor: Perry John Underwood, 120 Kenwood Drive, Lake Cathie NSW 2445 (AU)

( * ) Notice: Subject to any disclaimer, the term of this patent is extended or adjusted under 35 U.S.C. 154(b) by 0 days.

(21) Appl. No.: 09/646,619

(22) PCT Filed: Mar. 19, 1999

(86) PCT No.: PCT/AU99/00196

§ 371 (c)(1),
(2), (4) Date: Nov. 3, 2000

(87) PCT Pub. No.: WO99/47413

PCT Pub. Date: Sep. 23, 1999

(30) Foreign Application Priority Data

Mar. 19, 1998 (AU) ..... 59428/98

(51) Int. Cl.[7] ..... B63B 1/00; A62B 35/00
(52) U.S. Cl. ..... 441/75; 119/770
(58) Field of Search ..... 441/74, 75; D21/801, D21/804, 810; 119/769, 770; 224/219, 220, 221, 222

(56) References Cited

U.S. PATENT DOCUMENTS 4,479,785 A 10/1984 Tugwood et al.
4,729,345 A * 3/1988 Anderson ..... 119/96
4,847,729 A * 7/1989 Hee ..... 361/220
5,194,026 A * 3/1993 Corwin et al. ..... 441/75
5,205,449 A 4/1993 Davies
5,461,200 A 10/1995 Norcia
5,526,006 A * 6/1996 Akahane et al. ..... 343/718
5,938,492 A * 8/1999 Carlini ..... 441/75
6,000,979 A * 12/1999 Stewart ..... 441/75

OTHER PUBLICATIONS

"A Closer Look at the Power Cord", advertisement in "Surfing Magazine", May 1980, vol. 16, No. 5.*

* cited by examiner

*Primary Examiner*—S. Joseph Morano
*Assistant Examiner*—Andy Wright
(74) *Attorney, Agent, or Firm*—Paul & Paul

(57) ABSTRACT

A leash for securing a surfboard t a limb of a rider comprises a strap 9120 adapted to be fastened around the limb and a cord (36) connected to the strap at one end and attachable to the board at the other. The strap may bear ribs (30) on its inner face, and/or be shaped to match, say, the achilles region of the ankle, to prevent rotation of the strap around the limb. Either the region (32) of the strap may be shaped, or the proximal portion of the cord (34) may be bent, so that when worn the leash will assume a line offset from a line trailing directly behind the user. The above features are designed to lessen the chance of the rider becoming entangled in the leash.

30 Claims, 6 Drawing Sheets

LEASH FOR SECURING A SURF CRAFT TO A LIMB OF A PERSON

FIELD OF THE INVENTION

The present invention relates to a leash suitable for use in securing a surf craft to a limb of a person for the purpose of avoiding loss of the surf craft in the event of the person falling from the craft or otherwise being separated from it.

BACKGROUND OF THE INVENTION

The use of leashes by surfers to tie their surfboard or body board to either their ankle or wrist is well known. Such leashes comprise a strap and an elongate cord that is generally formed from an elastic material such as polyurethane. The cord is attached to the strap so as to extend rearwardly therefrom and trail behind the limb of the surfer in use.

However, due to its flexible nature the cord may float around the limb of the surfer while he or she is waiting for a wave and so be tangled with the limb when the surfer attempts to catch the wave. This is highly undesirable as it may result in the surfer missing the wave or alternatively, inhibit the movement of the surfer during the ride.

In light of this, a leash with a cord coiled in the form of a spring has been provided. In this instance, the cord is again attached to the rear of the strap so as to trail behind the limb to which the strap is attached. While this arrangement reduces the free movement of the cord in the water it nevertheless is still able to gather closely around the limb and so the possibility of being caught by the limb remains.

A retractable leash has also been proposed in Australian patent application 82070/91. That leash comprises a strap carrying a reel about which the cord is wrapped. A coil spring associated with the reel acts to cause the reel to rotate when there is slack in the cord so that the slack is thereby wound onto the reel. While the arrangement reduces the free movement of the cord in the water it is prone to failure due to its reliance on the movement of mechanical parts. The straps of prior art leashes may also slip about the surfer's limb which exacerbates the problem of entanglement with the cord and requires the surfer to frequently readjust the position of the strap.

SUMMARY OF THE INVENTION

It is an aim of the present invention to address one or more problems of the prior art.

In one aspect of the present invention there is provided a leash for securing a surf craft to a limb of a person, the leash comprising:

a strap with an inner face and an opposite outer face, and which is adapted for being fastened around the limb; and a cord with a proximal end region attached to the strap, and an opposite distal end region for attachment to the surf craft;

wherein the proximal end region of the cord is maintained in a biased position so as to be biased to one side of the limb from a position trailing behind the limb, when the strap is fastened around the limb such that the inner face of the strap is pressed against said limb.

Generally, the strap will receive the cord and be adapted to hold the cord in the biased position. Alternatively, the proximal end region of the cord may be adapted so as to cause the cord to be biased to the one side of the limb.

In another aspect of the invention there is provided a cord for a leash that is suitable for securing a surf craft to a limb of a person, wherein the leash includes a strap adapted for being fastened around the limb and having an inner face and an opposite outer face, and the cord has a distal end region for attachment to the surf craft and a proximal end region for attachment to the strap, the proximal end region of the cord being adapted to cause the cord to be biased from a position trailing behind the limb to one side of said limb, when the proximal end region of the cord is attached to the strap and when the strap is fastened around the limb so that the inner face thereof is pressed against said limb.

In a further aspect of the invention there is provided a strap for attachment to a cord for securing a surf craft to a limb of a person, wherein the strap is adapted for being fastened around the limb and has an outer face and an opposite inner face, and is further adapted to receive an end region of the cord such that the cord is thereby biased from a position trailing the limb to one side of the limb, when the strap is fastened around the limb such that the inner face of the strap is pressed against said limb.

Accordingly, the strap can be fastened around the limb such that the cord is biased to the side of the limb away from the direction of travel in which the limb is moved when the surfer assumes his or her paddling or normal riding position. This inhibits the cord from gathering around the limb while the surfer waits to catch a wave and as such, the possibility of the cord becoming caught around or under the surfers limb is thereby reduced.

The side of the limb to which the cord is biased can be altered by simply rotating the strap about the cord through 180° prior to fastening the strap to the limb. This allows a single leash of the invention to be used by a surfer irrespective of whether the leash is attached to a right or left limb when in his or her normal riding position. Accordingly, the invention provides a simple and relatively inexpensive way of dealing with the problem of cord entanglement around the limb.

In still another aspect of the invention there is provided a leash for securing a surf craft to a limb of a person, and comprising:

a strap with an inner face and an opposite outer face, and being adapted to be fastened around the limb; and a cord with a proximal end region attached to the strap and a distal end region for attachment to the surf craft;

wherein the inner face of the strap is shaped to substantially correspond to the contour of a region of the limb to thereby inhibit the strap from rotation about the limb, when the strap is fastened around said region of the limb such that the inner face of the strap is pressed against said limb.

In a yet further aspect of the invention there is provided strap for securing a cord to a limb of a person, wherein the strap is attachable to the cord and has an inner face and an opposite outer face, and is adapted to be fastened around the limb, and wherein the inner face of the strap is shaped to substantially correspond to the contour of a region of the limb to thereby inhibit the strap from rotation about the limb, when the strap is fastened around said region of the limb such that the inner face of the strap is pressed against said limb.

In a still further aspect of the present invention there is provided leash for securing a surf craft to a limb of a person, comprising:

a strap with an inner face and an opposite outer face, and being adapted to be fastened around the limb; and a cord with a proximal end region attached to the strap and a distal end region for attachment to the surf craft;

wherein at least one protuberance for pressing against the limb to thereby inhibit the strap from rotation about the limb when the strap is fastened around said limb such that the inner face of the strap is pressed against the limb, is defined on the strap.

In another aspect of the invention there is provided strap for securing a cord to a limb of a person, wherein the strap has an inner face and an opposite outer face and is adapted to be fastened around the limb, and at least one raised protuberance for pressing against the limb to thereby inhibit the strap from rotation about the limb when the strap is fastened around said limb such that the inner face of the strap is pressed against the limb, is defined on the strap.

Be inhibiting the strap from rotating about the limb the possibility of the cord being caught or becoming entangled with the limb is also substantially reduced.

The strap may be made from one or more of a rubberised or plasticised material, neoprene, ethylenevinyl acetate (EVA), polyethylene (PE), EVA-PE and polyurethane. The cord will typically be made from polyurethane although any suitable elastic material may be used.

The features and advantages of the invention will now be described in further detail below with reference to a number of embodiments illustrated in the accompanying drawings.

BRIEF DESCRIPTION OF THE ACCOMPANYING DRAWINGS

DETAILED DESCRIPTION OF PREFERRED EMBODIMENTS OF THE INVENTION

Figure 1:
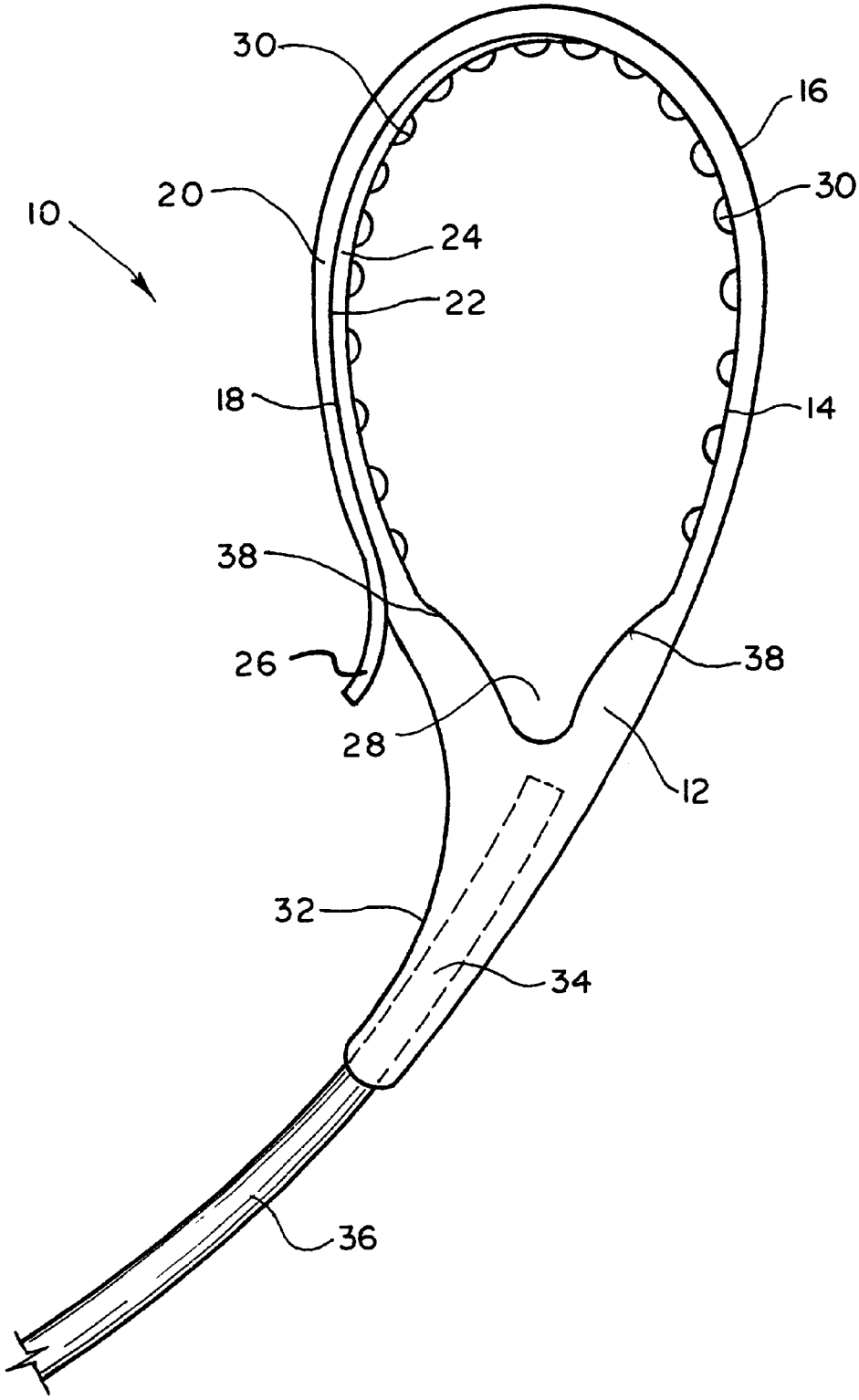
FIG. 1 is a plan view of a strap of a leash of the invention.

The leash 10 shown in FIG. 1 has a strap 12 with an inner face 14 and an opposite outer face 16. The strap is formed from a rubberised material and is able to be wrapped around the ankle of a surfers leg.

A strip of hook tape 18 is fixed to the outer face of an end area 20 of the strap so as to engage with a corresponding strip of loop tape 22 fixed to the inner face 14 of opposite end area 24 so as to thereby fasten the strap around the ankle.

As can be seen, the strap 12 is provided with a tab 26 which can be grasped to assist in peeling the hook tape 18 and loop tape 22 apart to thereby release the strap from the ankle. In the embodiments shown, the hook and loop tape was moulded in position when the strap 12 was formed but may simply be sewn onto the strap 12 if desired.

The inner face 14 of the strap 12 is provided with a recess 28 shaped to substantially correspond to the contour of the achilles region of the ankle so that rotation of the strap about the ankle in use is thereby inhibited. Rotation of the strap about the ankle is also inhibited by the provision of protuberances in the form of raised ribs 30 extending across the strap. The ribs are integrally formed with the strap and act by forming shallow furrows in the skin of the when the strap is fastened therearound. Rather than ribs, the protuberances may be provided in the form of raised studs.

The strap also has a guide 32 that receives and holds proximal end region 34 of flexible cord 36 as indicated in phantom outline. The cord is formed from polyurethane and so is elastic. Moreover, the end region 34 of the cord extends rearwardly from the strap 12 and is orientated by guide 32 so as to be biased to one side of the ankle once strap 12 has been fastened to the surfer's limb such that the achilles region of the ankle is received in recess 28. This directs the cord away from the limb and thereby reduces the possibility of the cord being caught by the limb when the surfer moves from a prone position to a riding stance.

Figure 2:
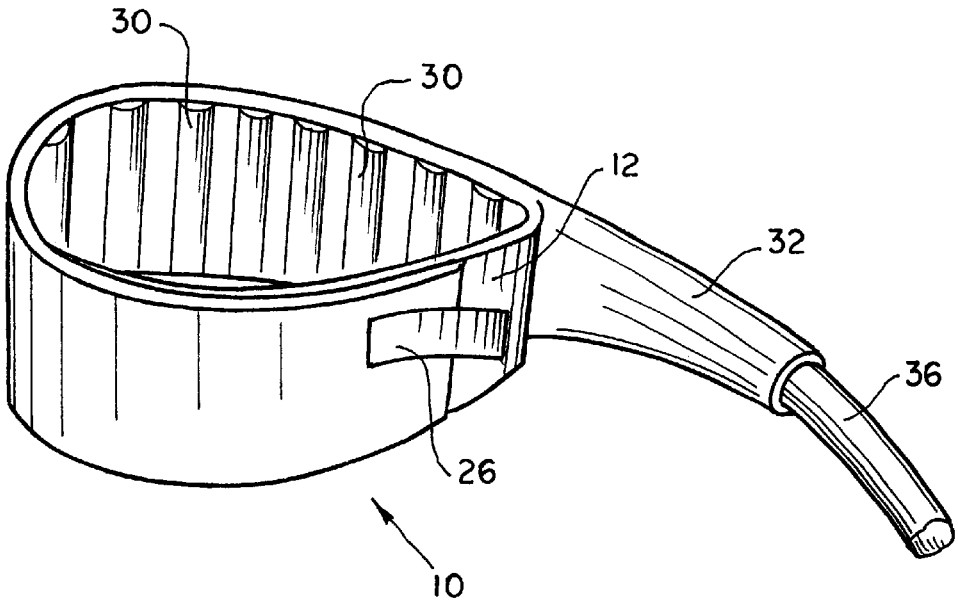
FIG. 2 is an elevated side view of the strap of FIG. 1.

As indicated in FIG. 2, the end region 34 of the cord 36 is also directed at a downwardly sloping angle relative to the rear face 16 of the strap. This further assists in inhibiting the cord from floating or curling in the immediate vicinity of the ankle and hence further reduces the possibility of the cord being caught by the limb.

The guide 32 is able to be flexed relative to the remainder of the strap so that when the cord is tensioned, the guide can be orientated in the direction from which the tension is being applied to thereby substantially avoid the strap from being pulled around the ankle. However, once the tension on the cord is removed the guide returns to its normal resting position due to the resilience of the material from which the cord is formed such that the end region 34 of the cord is once more orientated to the one side of the ankle.

Figure 3:
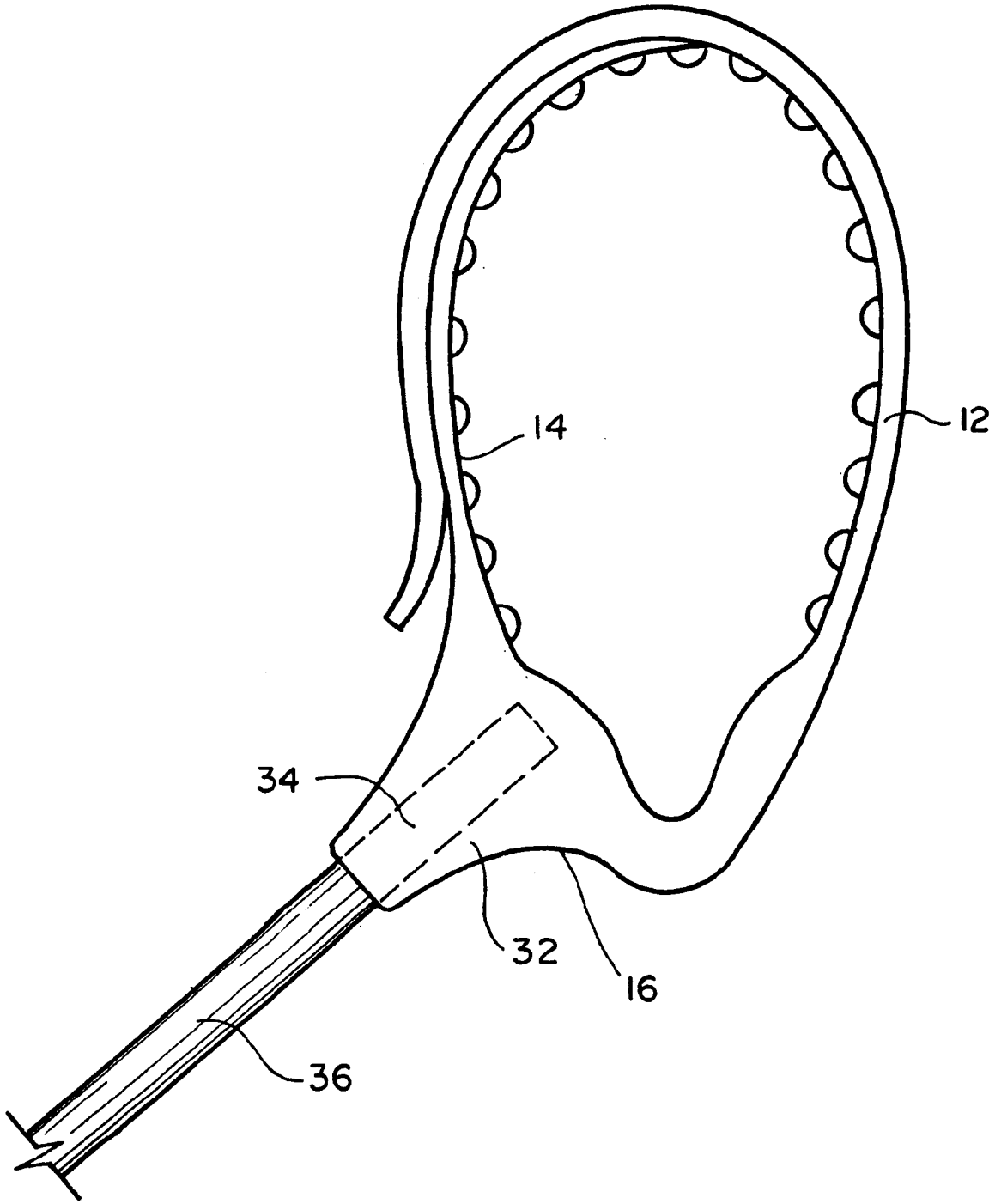
FIG. 3 is a plan view of another strap of a leash of the invention.

Another strap is illustrated in FIG. 3. As shown, the guide 32 is formed in an offset position at the rear of the strap so that the cord 36 is again biased to one side of the ankle when the strap is fastened around the ankle in use.

Figure 4:
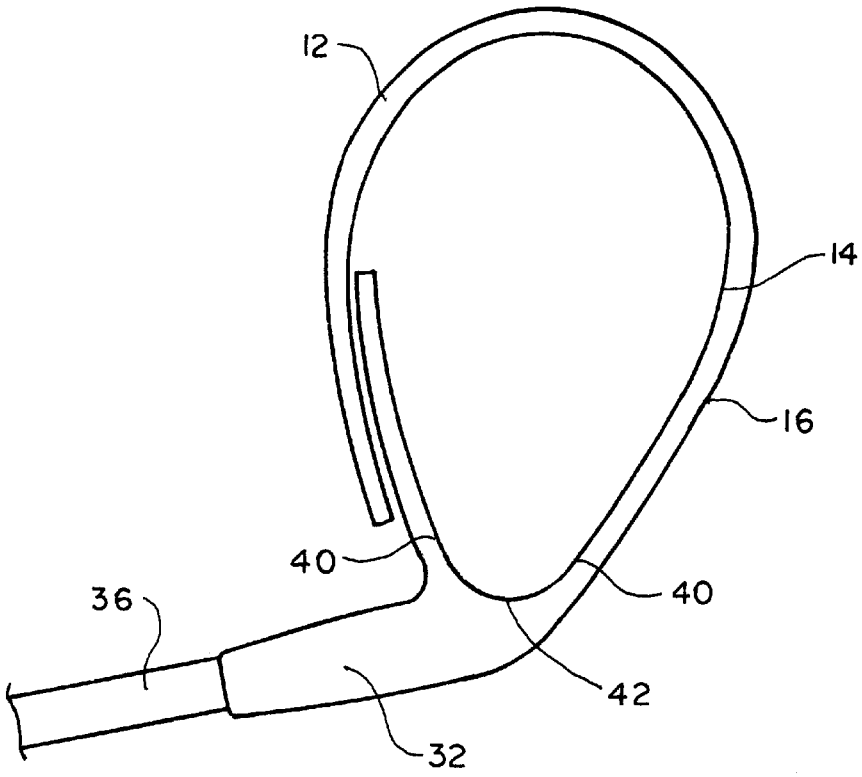
FIG. 4 is a plan view of a yet further strap of a leash of the invention.

Yet another embodiment of the invention is shown in FIG. 4. In this instance, the end region 34 of the cord 36 is orientated with respect to strap 12 at a sharper angle compared to that of the strap shown in FIG. 1 or FIG. 3. The inner face 14 of the strap 12 is also shaped to substantially correspond to the achilles region of an ankle but in this instance rather than being provided with arcuate surfaces 38 as in the case of the earlier described straps, the inner face 14 has generally flat surfaces 40 which converge to curved trough 42 formed to receive and wrap closely around the achilles tendon.

Figure 5:
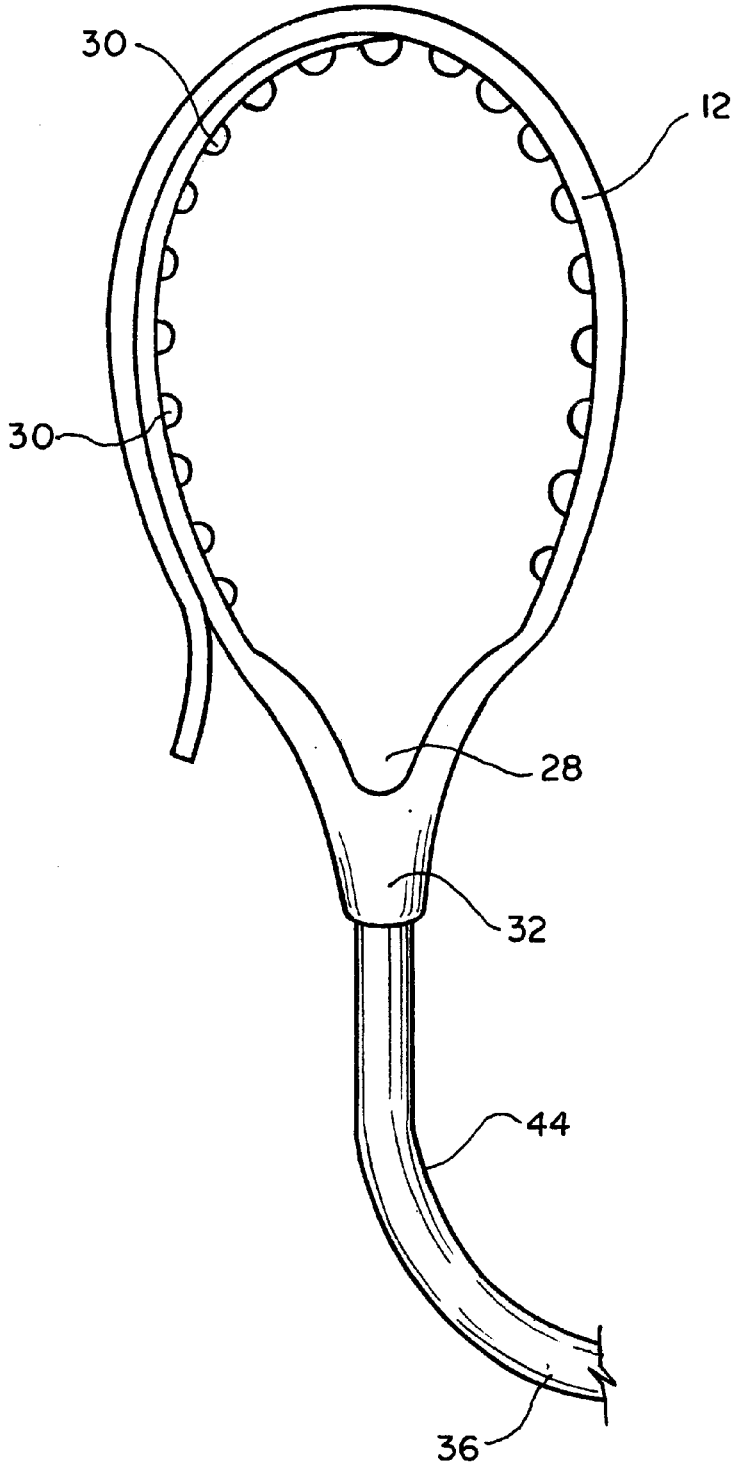
FIG. 5 is a partial plan view illustrating a cord of a leash of the invention.

In the leash shown in FIG. 5, the cord 36 has a permanently formed bend 44 in its end region 34 which causes the cord to be directed sidewardly away from the strap at angle and so be biased to one side of the ankle in use. The bend may be formed by any known method. One such method involves holding the cord at the desired curvature in a jig and heating the cord to a temperature so as to sufficiently soften the polyurethane prior to immersing the cord in cold water. The cord can be removed from the jig once it has been cooled. The heat may be applied to the cord with the use of a heat blower or alternatively, soaking the cord in boiling water.

In yet another form, the end region of the cord may be formed with an extension in the form of a leg that projects from one side of the cord and is of sufficient length to press against one side of the strap to thereby cause the cord to be biased to an opposite side of the ankle when the strap is fastened around the ankle in use.

Figure 6:
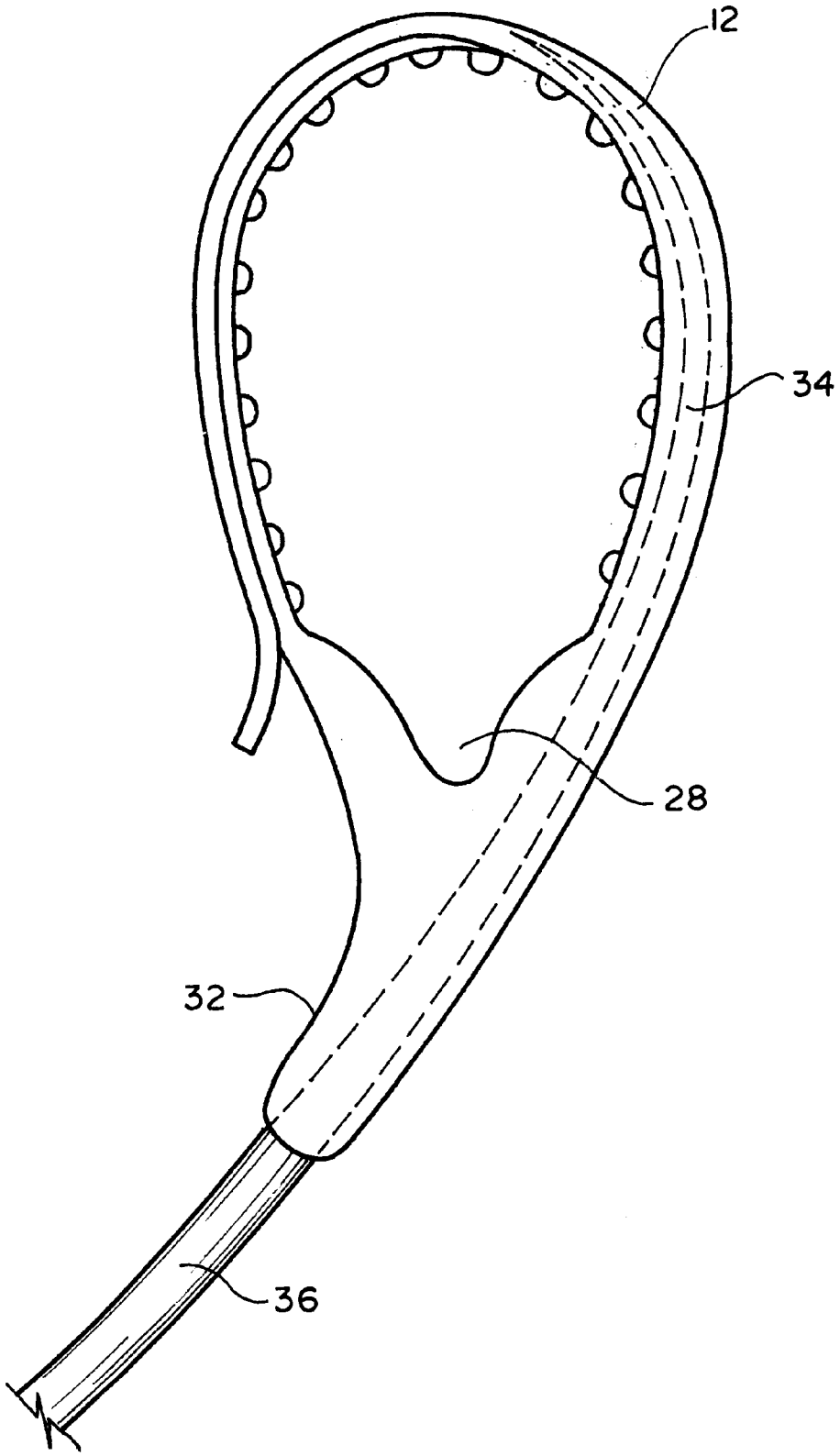
FIG. 6 is a plan view of a still another strap of a leash of the invention.

The cord 36 can be secured to a strap 12 by forming the guide 32 around the end region of the cord using any conventionally known injection moulding, thermoforming or low pressure casting method. To strengthen the attachment to the strap, the proximal end region 34 of the cord may be flattened and extend along through the strap so as to be able to be partially wrapped around the ankle as shown in FIG. 6.

A metallic pin extending through the cord and the guide 32 may also be provided wherein opposite ends of the pin are flanged to prevent its dislodgment from the leash. In addition, a fastening clip can be tightly wrapped around the guide so as to cause the end region 34 of the cord to be fixedly grasped. If desired, the strap 12 maybe performed and the cord simply inserted into the guide prior to being secured to the strap by way of such metal pins. Suitable adhesives may also be used within the guide to assist in the securing of the cord to the strap.

Figure 7:
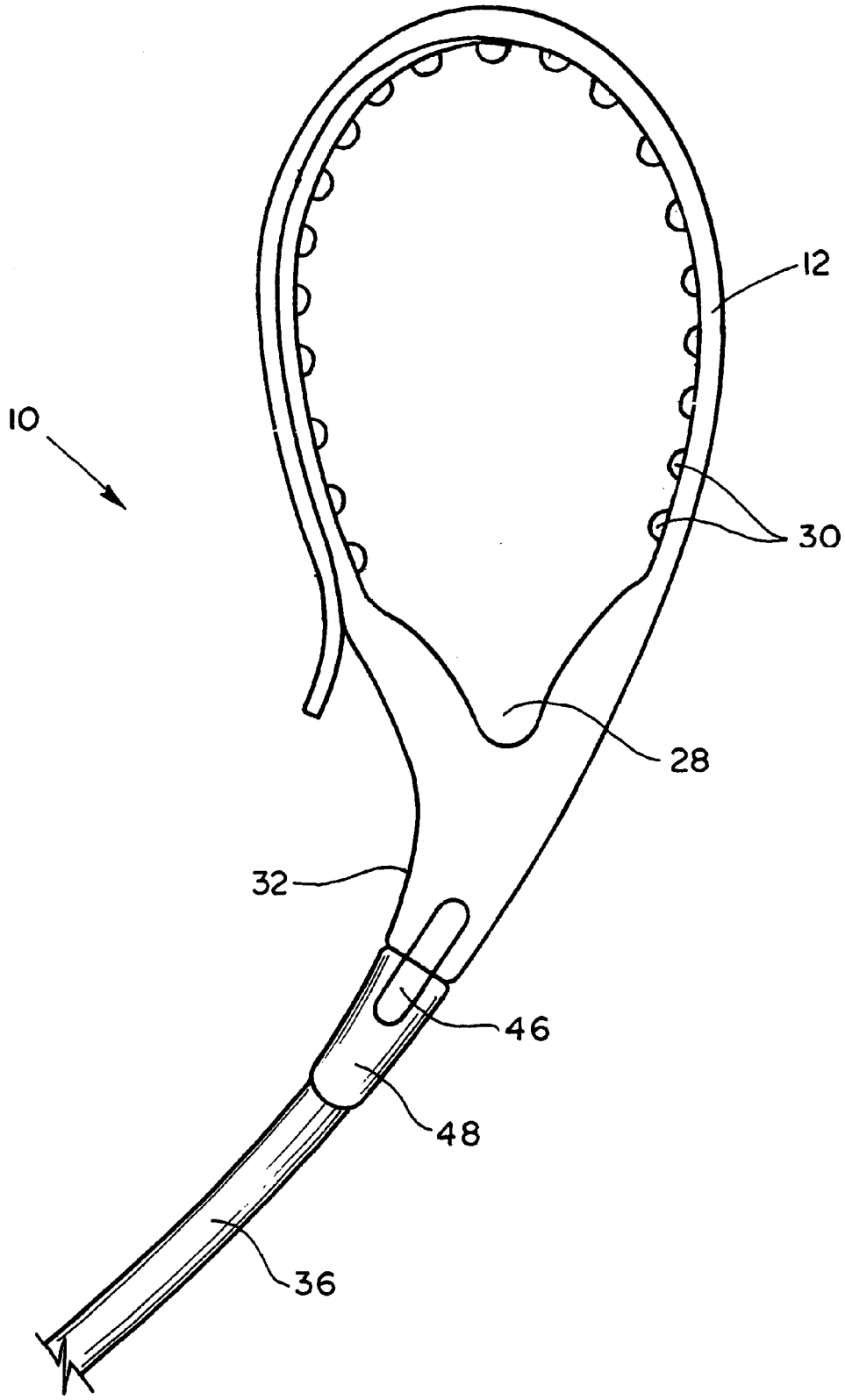
FIG. 7 is a plan view of a strap of another embodiment of a leash of the invention.

In the embodiment shown in FIG. 7, the guide 32 of the strap incorporates a swivel generally indicated by the numeral 46 which allows the end section 48 of the guide and hence the cord to rotate about an axis extending along the guide to thereby inhibit twisting of the cord as may occur when a surfer falls from his or her surfboard and as such further reduce the possibility of the cord subsequently gathering around the surfer's ankle. As will be readily appreciated, the end region 34 of the cord terminates within the guide slightly before the swivel. The swivel may consist of a brass or other substantially non-corrosive metallic swivel securely held within the guide 32 such that effective attachment of the cord to the strap is maintained. Again, metal pins may extend through the guide 32 and the swivel to thereby secure the swivel in position within the strap.

While not shown, a woven loop extends from the opposite distal end of the cords 36 of the leashes illustrated in the accompanying drawings as is commonly known to enable the leash to be attached to a plug on a deck of a surfboard.

Although the guide has been shown as being angled downwardly relative to the rear side 16 of the strap, embodiments may be provided wherein the guide is angled upwardly.

In addition, the invention is not limited to leashes or straps for fastening around the ankle of a surfer and indeed, embodiments may be provided wherein the inner side 14 is shaped to match the curvature of the lateral or ventral side of the wrist or bicep region of the arm of surfers such as body board riders, or even the knee region.

Accordingly, it will be appreciated by the skilled addressee that numerous variation and modification are possible without departing from the scope of the invention which is defined in the following claims.

What is claimed is:

1. A leash for securing a surf craft to a limb of a person, the leash comprising:

a strap with an inner face and an opposite outer face, and which is adapted for being fastened around the limb; and a cord with a proximal end region attached to the strap, and an opposite distal end region for attachment to the surf craft;

wherein the proximal end region of the cord is maintained in a biased position so as to be biased to one side of the limb from a position trailing behind the limb, when the strap is fastened around the limb such that the inner face of the strap is pressed against said limb, wherein the inner face is pre-shaped to substantially correspond to the contour of a region of the limb to thereby inhibit the strap from rotation about the limb when the strap is fastened around said region of the limb, and Wherein the limb is a leg and the inner face of the strap is shaped to substantially correspond to the contour of the Achilles region of the ankle and so receive that region of the limb when the strap is fastened around the limb of the person.

2. A leash according to claim 1 wherein the strap is adapted to hold the proximal end region of the cord to the one side of the limb.

3. A leash according to claim 2 wherein the strap has a guide which receives and holds the proximal end region of the cord such that the cord is thereby caused to be biased to the one side of the limb.

4. A leash according to claim 3 wherein the guide incorporates a swivel that enables the cord to be rotated about its longitudinal axis relative to the strap.

5. A leash according to claim 1 wherein the proximal end region of the cord itself is adapted to be biased to the one side of the limb.

6. A leash according to claim 5 wherein a bend is formed in the proximal end region of the cord and wherein the bend causes the cord to be biased to the one side of the limb.

7. A leash according to claim 1 wherein the proximal end region of the cord is attached to the strap at a position for location behind the achilles region of the ankle when the strap is fastened around the limb.

8. A leash according to claim 1 wherein at least one protuberance for pressing against the limb to thereby inhibit the strap from rotating about the limb when the strap is fastened around said limb, is defined on the strap.

9. A leash according to claim 8 wherein a plurality of protuberances in the form of transverse ribs spaced apart from each other along the strap are defined thereon.

10. A leash according to claim 9 wherein the ribs extend substantially parallel to one another.

11. A cord for a leash that is suitable for securing a surf craft to a limb of a person, wherein the leash includes a strap adapted for being fastened around the limb and having an inner face and an opposite outer face, and the cord has a distal end region for attachment to the surf craft and a proximal end region for attachment to the strap, the proximal end region of the cord being adapted to cause the cord to be biased from a position trailing behind the limb to one side of said limb, when the proximal end region of the cord is attached to the strap and when the strap is fastened around the limb so that the inner face thereof is pressed against said limb.

12. A cord according to claim 11 wherein a bend is formed in the proximal end region of the cord for causing said biasing.

13. A strap for attachment to a cord for securing a surf craft to a limb of a person, wherein the strap is adapted for being fastened around the limb and has an outer face and an opposite inner face, and is further adapted to receive an end region of the cord such that the cord is thereby biased from a position trailing the limb to one side of the limb, when the strap is fastened around said limb, wherein the inner face is pre-shaped to substantially correspond to the contour of a region of the limb to thereby inhibit the strap from rotation about the limb when the strap is fastened around said region of the limb, and Wherein the limb is a leg and the inner face of the strap is shaped to substantially correspond to the contour of the Achilles region of the ankle and so receive that region of the limb when the strap is fastened around the limb of the person.

14. A strap according to claim 13 wherein the strap has a guide for receiving and holding the proximal end region of the cord to thereby cause the cord to be biased to one side of the limb.

15. A strap according to claim 14 wherein the guide incorporates a swivel for enabling the cord to be rotated about its longitudinal axis relative to the strap.

16. A leash for securing a surf craft to a limb of a person, and comprising:

a strap with an inner face and an opposite outer face, and being adapted to be fastened around the limb; and a cord with a proximal end region attached to the strap and a distal end region for attachment to the surf craft;

wherein the inner face of the strap is shaped to substantially correspond to the contour of a region of the limb to thereby inhibit the strap from rotation about the limb, when the strap is fastened around said region of the limb such that the inner face of the strap is pressed against said limb.

17. A leash according to claim 16 wherein the proximal end region of the cord is attached to the strap at a position for location behind the achilles region of the ankle when the strap is fastened around the limb.

18. A leash according to claim 16 wherein at least one protuberance for pressing against the limb is thereby inhibit the strap from rotating about the limb when the strap is fastened around said limb, is defined on the strap.

19. A leash according to claim 18 wherein a plurality of protuberances in the form of transverse ribs spaced apart from each other along the strap are defined thereon.

20. A leash according to claim 19 wherein the ribs extend substantially parallel to one another.

21. A strap for securing a cord to a limb of a person, wherein the strap is attachable to the cord and has an inner face and an opposite outer face, and is adapted to be fastened around the limb, and wherein the inner face of the strap is shaped to substantially correspond to the contour of a region of the limb is thereby inhibit the strap from rotation about the limb, when the strap is fastened around said region of the limb such that the inner face of the strap is pressed against said limb, wherein the inner face is pre-shaped to substantially correspond to the contour of a region of the limb to thereby inhibit the strap from rotation about the limb when the strap is fastened around said region of the limb, and Wherein the limb is a leg and the inner face of the strap is shaped to substantially correspond to the contour of the Achilles region of the ankle and so receive that region of the limb when the strap is fastened around the limb of the person.

22. A strap according to claim 21 wherein at least one protuberance for pressing against the limb to thereby inhibit the strap from rotation about the limb when the strap is fastened around said limb such that the inner face of the strap is pressed against the limb, is defined on the strap.

23. A leasing according to claim 22 wherein a plurality of protuberances in the form of transverse ribs spaced apart from each other along the strap are defined thereon.

24. A leash according to claim 23 wherein the ribs extend substantially parallel to one another.

25. A leash for securing a surf craft to a limb of a person, comprising:

a strap with an inner face and an opposite outer face, and being adapted to be fastened around the limb; and a cord with a proximal end region attached to the trap and a distal end region for attachment to the surf craft;

wherein at least one protuberance for pressing against the limb to thereby inhibit the strap from rotation about the limb when the strap is fastened around said limb such that the inner face of the strap is pressed against the limb, is defined on the strap, wherein the inner face is pre-shaped to substantially correspond to the contour of a region of the limb to thereby inhibit the strap from rotation about the limb when the strap is fastened around said region of the limb, and Wherein the limb is a leg and the inner face of the strap is shaped to substantially correspond to the contour of the Achilles region of the ankle and so receive that region of the limbs when the strap is fastened around the limb of the person.

26. A leash according to claim 25 wherein a plurality of protuberances in the form of transverse ribs spaced apart from each other along the strap are defined thereon.

27. A leash according to claim 26 wherein the ribs extend substantially parallel to one another.

28. A strap for securing a cord to a limb of a person, wherein the strap has an inner face and an opposite outer face and is adapted to be fastened around the limb, and at least one raised protuberance for pressing against the limb to thereby inhibit the strap from rotation about the limb when the strap is fastened around said limb such that the inner face of the strap is pressed against the limb, is defined on the strap, wherein the inner face is pre-shaped to substantially correspond to the contour of a region of the limb to thereby inhibit the strap from rotation about the limb when the strap is fastened around said region of the limb, and Wherein the limb is a leg and the inner face of the strap is shaped to substantially correspond to the contour of the Achilles region of the ankle and so receive that region of the limb when the strap is fastened around the limb of the person.

29. A strap according to claim 28 wherein a plurality of protuberances in the form of transverse ribs spaced apart from each other along the strap are defined thereon.

30. A leash according to claim 29 wherein the ribs extend substantially parallel to one another.

* * * * *

UNITED STATES PATENT AND TRADEMARK OFFICE

CERTIFICATE OF CORRECTION

PATENT NO. : 6,500,039 B1
DATED : December 31, 2002
INVENTOR(S) : Perry John Underwood It is certified that error appears in the above-identified patent and that said Letters Patent is hereby corrected as shown below:

Title page,
Item [57], ABSTRACT,
Line 1, replace “t” with -- to --;
Line 2, delete “9120”;
Line 5, replace “achilles” with -- Achilles --;

Column 2,
Line 28, replace “surfers” with -- surfer’s --;

Column 3,
Line 40, delete “a” before “still”.
Line 46, change “a surfers leg” to -- a surfer’s leg --;
Line 59, change “achilles” with -- Achilles --;

Column 4,
Line 2, after “in the skin of the” insert -- ankle of the surfer’s leg --;
Lines 11, 40 and 45 replace “achilles” with -- Achilles --;
Line 48, change “at angle” to -- at an angle --;

Column 5,
Line 11, replace “maybe” with -- may be --;
Line 46, replace “variation and modfication” with -- variations and modifications --;

Column 6,
Line 1, replace “Wherein” with -- wherein --;
Line 24, replace “achilles” with -- Achilles --;
Line 46, after “limb” insert --, wherein the inner face is pre-shaped to substantially correspond to the contour of a region of the limb to thereby inhibit the strap from rotation about the limb when the strap is fastened around said region of the limb, and wherein the limb is a leg and the inner face of the strap is shaped to substantially correspond to the contour of the Achilles region of the ankle and so receive that region of the limb when the strap is fastened around the limb of the person. --;
Line 62, replace “Wherein” with -- wherein --;

UNITED STATES PATENT AND TRADEMARK OFFICE

CERTIFICATE OF CORRECTION

PATENT NO. : 6,500,039 B1
DATED : December 31, 2002
INVENTOR(S) : Perry John Underwood It is certified that error appears in the above-identified patent and that said Letters Patent is hereby corrected as shown below:

Column 7,
Line 15, after "limb" insert --, wherein the inner face is pre-shaped to substantially correspond to the contour of a region of the limb to thereby inhibit the strap from rotation about the limb when the strap is fastened around said region of the limb, and wherein the limb is a leg and the inner face of the strap is shaped to substantially correspond to the contour of the Achilles region of the ankle and so receive that region of the limb when the strap is fastened around the limb of the person. --;
Line 21, change "is therby" to -- to therby --;
Line 43, replace "Wherein" with -- wherein --;
Line 53, replace "leasing" with -- strap --;

Column 8,
Line 1, replace "leash" with -- strap --;
Line 7, replace "trap" with -- strap --;
Lines 19 and 42, replace "Wherein" with -- wherein --;
Line 22, replace "limbs" with -- limb --;

Signed and Sealed this

Tenth Day of August, 2004

JON W. DUDAS
*Acting Director of the United States Patent and Trademark Office*